US008434281B2

(12) United States Patent
Halfon et al.

(10) Patent No.: US 8,434,281 B2
(45) Date of Patent: May 7, 2013

(54) SYSTEM AND DEVICE FOR STIFFENING A DOOR

(75) Inventors: Amos Halfon, Moshav Staria (IL); Mordechai Harari, Rishon Lezion (IL)

(73) Assignee: Hardoor Mechanisms Production Ltd., Rishon Lezion (IL)

( * ) Notice: Subject to any disclaimer, the term of this patent is extended or adjusted under 35 U.S.C. 154(b) by 177 days.

(21) Appl. No.: 12/302,891

(22) PCT Filed: Jun. 3, 2007

(86) PCT No.: PCT/IL2007/000671

§ 371 (c)(1), (2), (4) Date: Nov. 30, 2008

(87) PCT Pub. No.: WO2007/138605

PCT Pub. Date: Dec. 6, 2007

(65) Prior Publication Data

US 2009/0193736 A1 Aug. 6, 2009

Related U.S. Application Data

(60) Provisional application No. 60/809,824, filed on Jun. 1, 2006.

(51) Int. Cl.

| | |
|---|---|
| ***E04G 23/00*** | (2006.01) |
| *E04C 5/08* | (2006.01) |
| *E06B 3/82* | (2006.01) |
| *E04F 21/00* | (2006.01) |

(52) U.S. Cl.

USPC ..... 52/291; 49/396; 49/504; 52/223.1; 52/223.14; 52/514

(58) Field of Classification Search ..... 52/223.1, 52/223.14, 291, 594, 222, 514; 49/396, 504

See application file for complete search history.

(56) References Cited

U.S. PATENT DOCUMENTS

| | | | | | |
|---|---|---|---|---|---|
| 430,032 | A | * | 6/1890 | Kaiser | 49/503 |
| 1,295,368 | A | * | 2/1919 | Pilkington | 52/222 |
| 1,421,089 | A | * | 6/1922 | Kotun | 52/64 |
| 1,520,686 | A | * | 12/1924 | Andler | 49/501 |
| 1,577,629 | A | * | 3/1926 | Winge | 52/247 |
| 1,646,906 | A | * | 10/1927 | Freund | 52/800.1 |
| 1,708,351 | A | * | 4/1929 | Auld | 52/222 |
| 1,730,782 | A | * | 10/1929 | Reens | 52/291 |
| 1,994,203 | A | * | 3/1935 | Waldman | 52/234 |
| 2,382,357 | A | * | 8/1945 | Watter | 52/222 |
| 2,805,739 | A | * | 9/1957 | Dennison | 52/222 |

(Continued)

FOREIGN PATENT DOCUMENTS

| | | | |
|---|---|---|---|
| CH | 653087 | A * | 12/1985 |
| DE | 2836069 | A * | 3/1980 |

(Continued)

*Primary Examiner* — Brian Glessner
*Assistant Examiner* — Joseph J Sadlon
(74) *Attorney, Agent, or Firm* — The Law Office of Michael E. Kondoudis

(57) ABSTRACT

Presented herein is a system for stiffening and strengthening a door, said system comprising a plurality of stoppers each having a channel, wherein said stoppers are affixed to the door; and at least one stiffening rod seated within the channels of said stoppers; and means for shortening the span of said stiffening rod disposed between said stoppers; whereby shortening the span results in straightening the door.

3 Claims, 7 Drawing Sheets

U.S. PATENT DOCUMENTS

| | | | | | |
|---|---|---|---|---|---|
| 2,856,644 | A | * | 10/1958 | Dunham | 52/223.12 |
| 2,982,321 | A | * | 5/1961 | Hancock | 144/269 |
| 3,286,424 | A | * | 11/1966 | Weyant | 52/291 |
| 3,425,161 | A | * | 2/1969 | Catlett et al. | 49/253 |
| 3,621,626 | A | * | 11/1971 | Tylius | 52/223.13 |
| 3,893,273 | A | * | 7/1975 | Sailor | 52/291 |
| 3,918,205 | A | * | 11/1975 | Rasmussen | 49/252 |
| 4,038,803 | A | * | 8/1977 | Schoeller | 52/741.1 |
| 4,163,348 | A | * | 8/1979 | Thomas, Jr. | 52/241 |
| 4,267,667 | A | * | 5/1981 | Ingham | 49/252 |
| 4,452,028 | A | * | 6/1984 | Norton et al. | 52/742.14 |
| 4,563,852 | A | * | 1/1986 | Achtenberg et al. | 52/742.14 |
| 4,575,980 | A | * | 3/1986 | Shuler | 52/291 |
| 5,491,935 | A | * | 2/1996 | Coxum | 52/92.2 |
| 6,161,339 | A | * | 12/2000 | Cornett et al. | 52/23 |
| 6,494,654 | B2 | * | 12/2002 | Espinosa | 411/353 |
| 6,688,058 | B2 | * | 2/2004 | Espinosa | 52/293.3 |
| 6,951,078 | B2 | * | 10/2005 | Espinosa | 52/23 |
| 7,762,030 | B2 | * | 7/2010 | Espinosa | 52/293.3 |
| 2003/0167711 | A1 | * | 9/2003 | Lstiburek | 52/223.4 |
| 2005/0081465 | A1 | * | 4/2005 | Crumley | 52/223.1 |

FOREIGN PATENT DOCUMENTS

| | | | | |
|---|---|---|---|---|
| DE | 3225675 | A1 | * | 1/1984 |
| DE | 3523738 | A1 | * | 1/1987 |
| DE | 3721172 | A | * | 1/1989 |
| DE | 29622285 | U1 | * | 4/1997 |
| DE | 29807020 | U1 | * | 8/1998 |
| DE | 102008012025 | A1 | * | 9/2009 |
| EP | 2107202 | A2 | * | 10/2009 |
| FR | 2264167 | A | * | 11/1975 |
| FR | 2585062 | A | * | 1/1987 |
| JP | 2000096930 | A | * | 4/2000 |
| JP | 2000230371 | A | * | 8/2000 |
| NL | 9101304 | A | * | 2/1993 |
| WO | WO/97/43098 | | | 11/1997 |

* cited by examiner

Prior art

SYSTEM AND DEVICE FOR STIFFENING A DOOR

This application is a National Stage of an international application No. 5 PCT/IL2007/000671, filed Jun. 3, 2007, which is incorporated herein by reference in its entirety.

BACKGROUND OF THE INVENTION

Field of Invention

Many cabinets, closets, and other doorways are equipped with sliding doors. While sliding doors are easy to install and operate, requiring no hinges or even door knobs, these doors, over time, are prone to distortions such as bowing, wherein the wood bends against the grain, and warping or twisting. It is known in the art to attach some sort of wooden stiffener to a sheet of wood to help prevent the bowing. Provided the stiffener itself does not distort, this may prove an effective method of strengthening a sliding door. However, when heavy items such as mirrors are hung on a sliding door, a simple wood stiffener may not be sufficient to prevent the distortion of the door.

Another solution is offered by WO9743098, herein incorporated by reference in its entirety, which teaches inserting a stiffener into a hole drilled across the grain through a sheet of wood. This may help prevent cupping, wherein the lateral sides of the sheet of wood bend towards each other, but may be ineffective against warping and does not address bowing at all.

SUMMARY OF THE INVENTION

It is an objective of the present invention to provide a system for protecting sliding doors as well as other panel type doors from bowing and warping. It is another objective of the present invention to provide a solution that addresses long-term problems. It is a further objective to provide such a system that is cost-effective, simple to install, and easy to maintain.

Accordingly, a system for stiffening and strengthening a door is provided, said system comprising: a plurality of stoppers each having a channel, wherein said stoppers are affixed to the door; at least one stiffening rod, wherein said stiffening rod is seated within the channels of said stoppers; and means for shortening the span of said stiffening rod disposed between said stoppers; whereby shortening the span results in straightening the door.

Additionally, said door may be a sliding door. Such a sliding door may be a panel door comprising solid wood or a metal profile or a hollow core.

Additionally, said sliding door may cover at least one entryway or cabinet.

Additionally, said means for shortening the span of said stiffening rod disposed between said stoppers may be at least two nuts that further secure said stiffening rod to said stoppers.

Additionally, said stiffening rod may be a threaded rod, and said stiffening rod may be of sufficient length to cover the height of the sliding door without interfering with the hanging hardware required by the sliding door.

Additionally, said stiffening rod may be attached to said sliding door by at least one upper stopper or central stopper or lower stopper.

Additionally, each stopper may be made of a sturdy material and may further have a channel through its middle, and the channel may have substantially the diameter of the stiffening rod.

Additionally, said upper stopper and said lower stopper may function together to hold the stiffening rod securely in an upright position and in close proximity to the desired plane of the sliding door.

Additionally, said plurality of central stoppers may be used to support and hold the stiffening rod in place.

Additionally, a plurality of nuts may be used for securing the stiffening rod to the upper and lower stoppers, and said nuts may be threaded onto the threaded areas of the stiffening rod, and as the nuts are tightened down on the stiffening rod, the span of the stiffening rod is shortened, thus forcing said sliding door to straighten.

Additionally, said nuts may be at least one of the following types: single hex nuts, paired nuts, nuts with locking washers.

BRIEF DESCRIPTION OF THE FIGURES

The subject matter regarded as the invention will become more clearly understood in light of the ensuing description of embodiments herein, given by way of example and for purposes of illustrative discussion of the present invention only, with reference to the accompanying figures, wherein.

Figure 1:
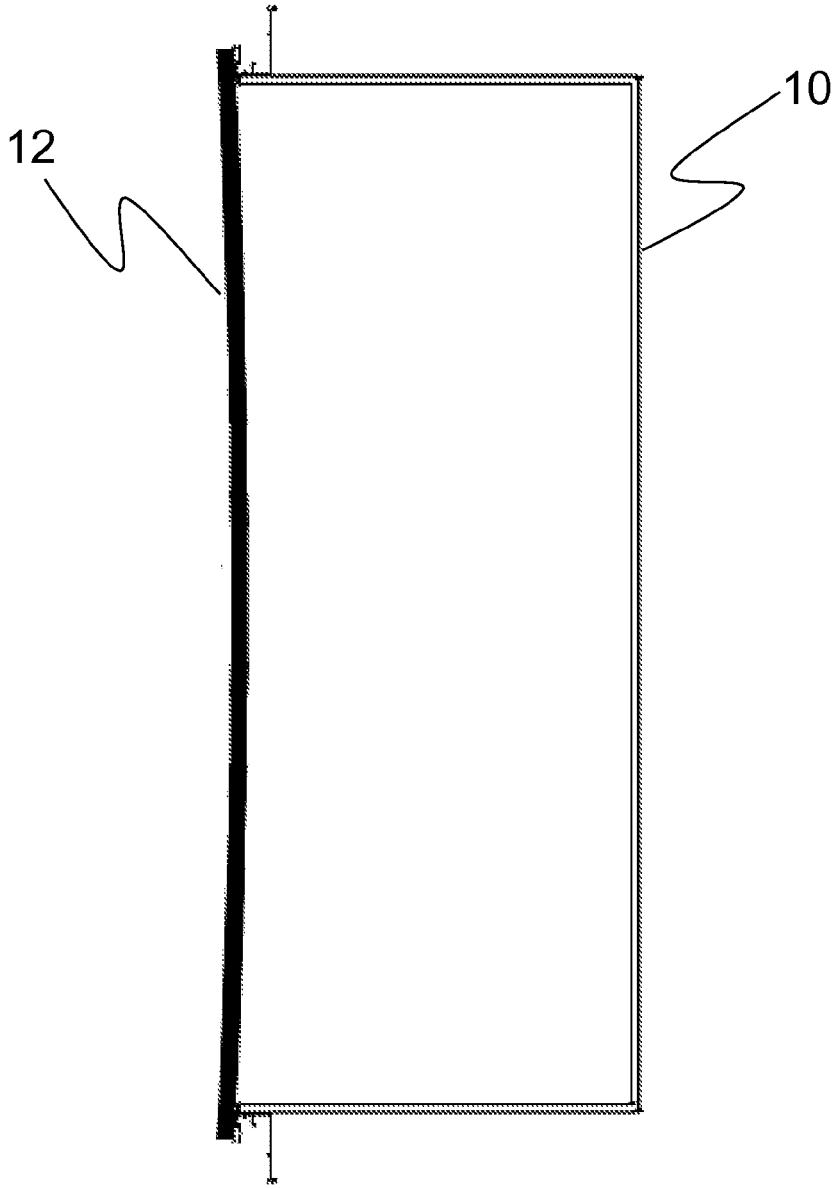
FIG. 1 is a sectional view of a closet equipped with a sliding door, wherein said door is bowed.

The figures together with the description make apparent to those skilled in the art how the invention may be embodied in practice.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF SOME EMBODIMENTS OF THE INVENTION

Figure 2:
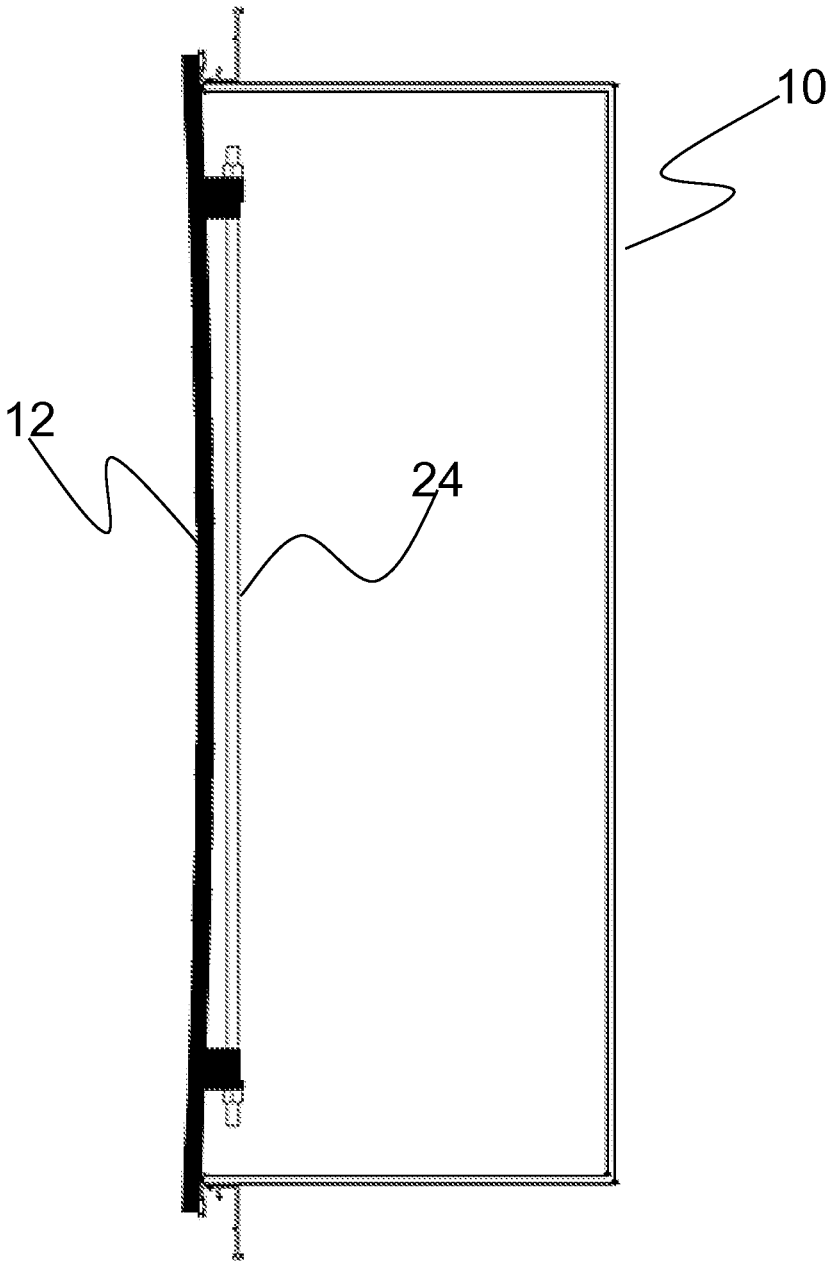
FIG. 2 is a sectional view of the same closet and door, wherein the door has been equipped with a stiffening rod of the present invention, and said stiffening rod is being tightened.
Figure 3:
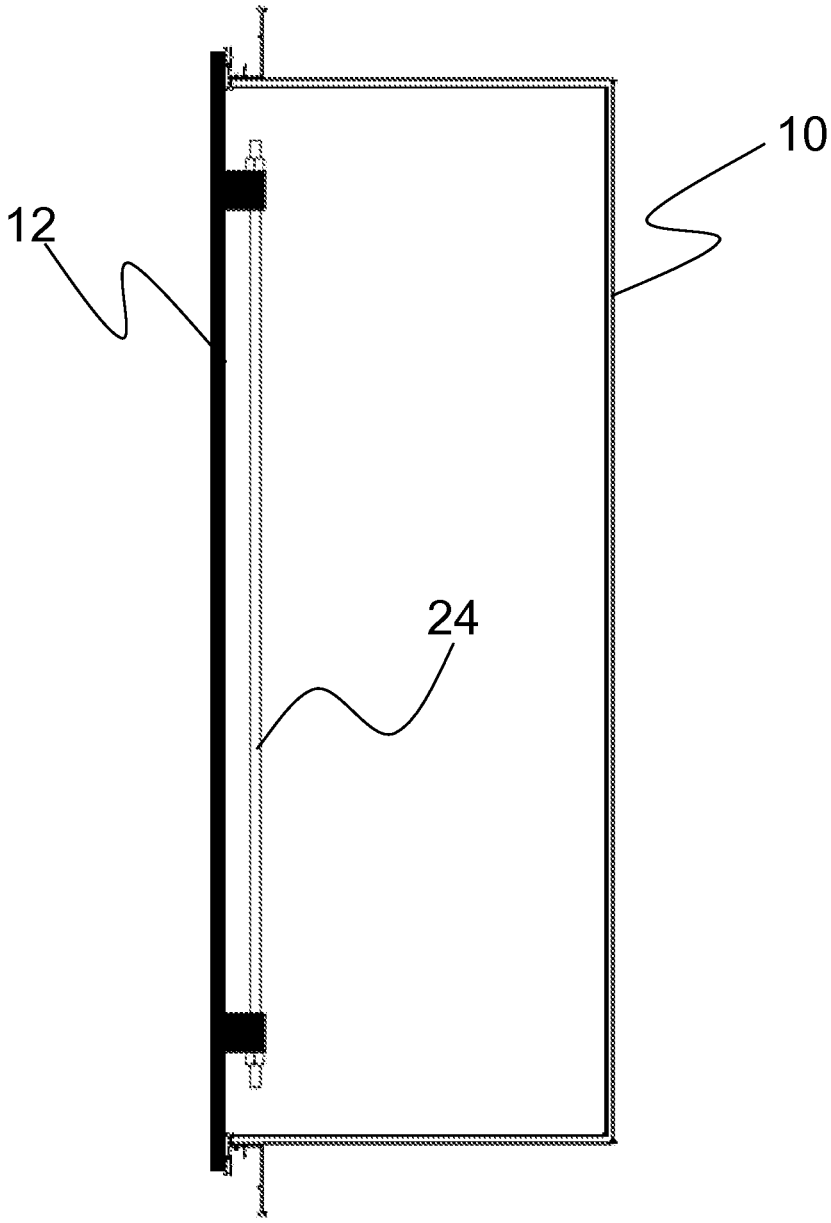
FIG. 3 is a sectional view of the same closet and door, wherein the door has been straightened by the stiffening rod system of the present invention.

Embodiments of the present invention provide a system for stiffening and reinforcing sliding doors, thereby delaying and even preventing the distortion of said doors that may occur over time. Such distortions may simply be the result of age or moisture or may result from, for example, the weight of a mirror mounted on a closet door causing said door to sag or bow. FIG. 1 describes such an example, wherein a closet 10 is equipped with a sliding door 12 that has become bowed. According to embodiments of the present invention, this distortion may be averted and even corrected by mounting a stiffening rod 24 onto sliding door 12 as shown in FIG. 2, which shows the same closet 10 and sliding door 12, now equipped with a stiffening rod 24 of the present invention. The vertical arrows indicate the force being exerted onto sliding door 12 as stiffening rod 24 is being tightened. The result is seen in FIG. 3, wherein the same sliding door 12 has been straightened and is being held in place by stiffening rod 24 of the present invention.

It is to be understood that an embodiment is an example or implementation of the invention. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions.

It is understood that the phraseology and terminology employed herein is not to be construed as limiting and is for descriptive purpose only.

The principles and uses of the teachings of the present invention may be better understood with reference to the accompanying description, figures and examples.

It is to be understood that the details set forth herein should not be construed as limiting any applications of the invention.

Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, integers or groups thereof and that the terms are not to be construed as specifying components, features, steps or integers.

The phrase "consisting essentially of", and grammatical variants thereof, when used herein, is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element.

It is to be understood that where the claims or specification refer to "a" or "an" element, such reference is not to be construed as there being only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

The term "method" refers to manners, means, techniques and procedures for accomplishing a given task including, but is not limited to those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

The terms "bottom", "below", "top" and "above" as used herein do not necessarily indicate that a "bottom" component is below a "top" component, or that a component that is "below" is indeed "below" another component or that a component that is "above" is indeed "above" another component. As such, directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

Figure 4:
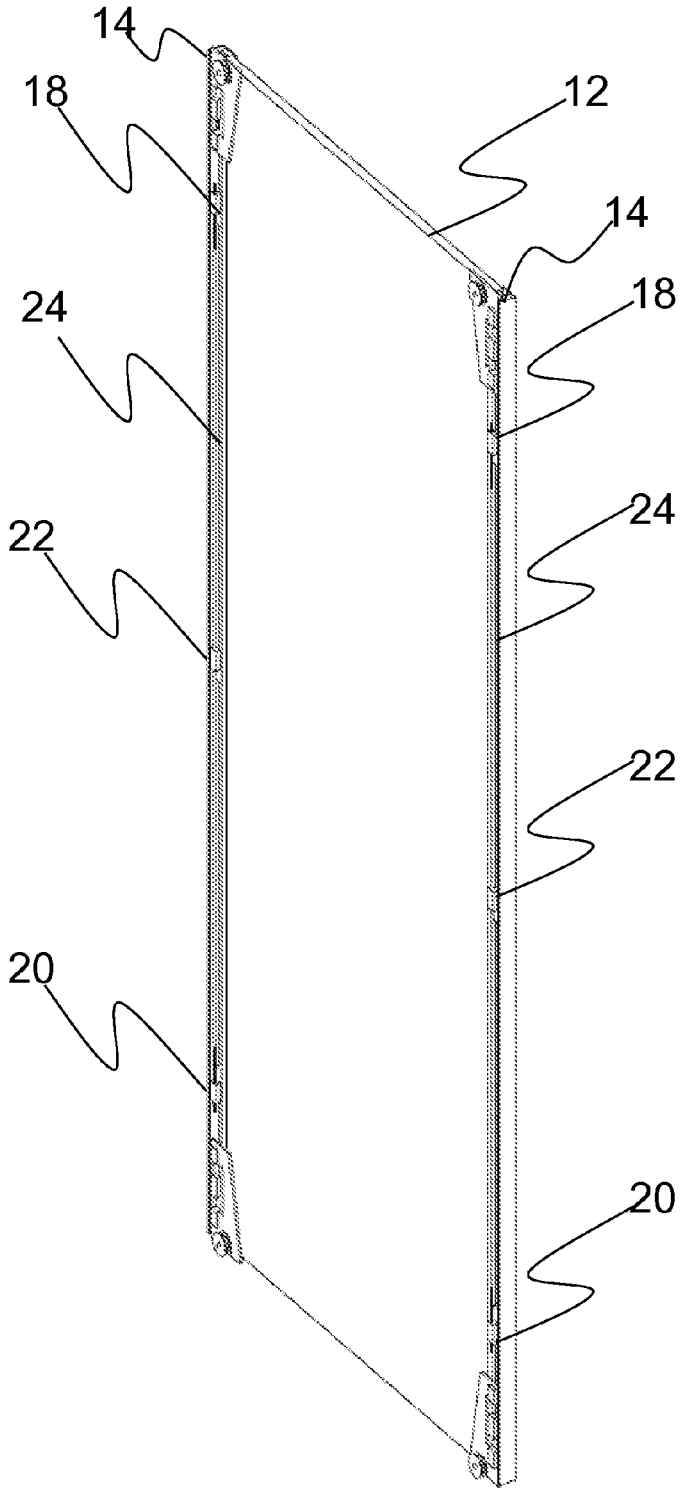
FIG. 4 is an isometric view of a door equipped with a stiffening rod of the present invention.

Referring now in detail to the figures, the present invention comprises a threaded stiffening rod 24 for strengthening a sliding door 12, a plurality of stoppers 18, 20, and 22 affixed to said sliding door 12 that hold stiffening rod 24 in place, and means for shortening a span between the stoppers, which may be, for example, at least two nuts 26 that further secure stiffening rod 24 to stoppers 18 and 22. FIG. 4 shows the configured components of an embodiment of the present invention disposed on a sliding door 12. According to some embodiments, sliding door 12 may reinforced with a metal profile 14 and further equipped with the aforementioned components of the present invention.

In addition to closets, the present invention is also applicable to doors covering other types of openings including, inter alia, entryways and cabinets. Furthermore, sliding door 12 may be any panel type door including, inter alia, hollow core and solid wood doors as well as metal doors and doors constructed from other materials. According to some embodiments of the present invention, sliding door 12 may be further equipped with an aluminum profile 14, wherein profile 14 is applied to at least one lateral edge of sliding door 12.

Stiffening rod 24 may be, for example, a metal rod of sufficient length to cover the height of sliding door 12 without interfering with the hanging hardware required by sliding door 12. According to such an embodiment, threaded areas 28 may be disposed on both ends of stiffening rod 24. According to some other embodiments of the present invention, stiffening rod 24 may be constructed from other suitable materials. Some embodiments of the present invention may utilize two or more shorter stiffening rods 24 that may be positioned along the length of sliding door 12.

Stiffening rod 24 may be attached to sliding door 12 by means of an upper stopper 18 and a lower stopper 20, and optionally, center stoppers 22. Each stopper 18, 20, and 22 is made of sturdy material and has a channel through its middle that is substantially the same diameter as stiffening rod 24. According to some embodiments of the present invention, upper stopper 18 and lower stopper 20 together function to hold stiffening rod 24 securely in an upright position and in close proximity to the desired plane of sliding door 12. Center stoppers 22 are used optionally to provide additional support to and help hold stiffening rod 24 in place. The number of center stoppers 22 required may vary according to the length of each stiffening rod 24. According to some other embodiments of the present invention, other types of fasteners may be used to secure stiffening rod 24 in place.

According to some embodiments of the present invention, nuts 26 may be used to secure stiffening rod 24 to upper stopper 18 and lower stopper 20, wherein nuts 26 are threaded onto threaded areas 28 of stiffening rod 24. As nuts 26 are tightened down on stiffening rod 24, the span of stiffening rod 24 that resides between upper stopper 18 and lower stopper 20 is shortened, thus forcing sliding door 12 to straighten. While some embodiments of the present invention may use a single hex nut at each end of stiffening rod 24, some other embodiments may use other securing methods such as, inter alia, paired nuts or nuts with locking washers.

Figure 5A:
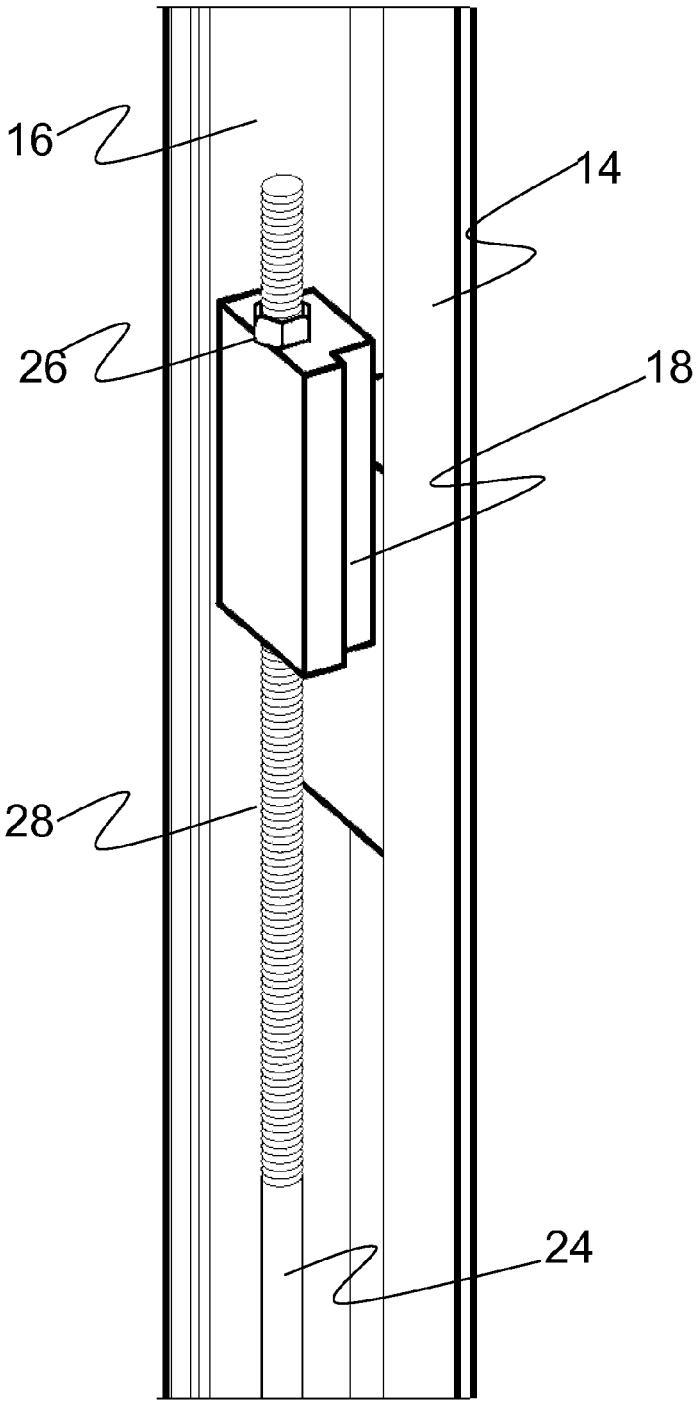
FIGS. 5A, 5B, and 5C show details of the components comprising an embodiment of the present invention.

FIG. 5A shows a detail of the upper area of a profile 14, with an upper stopper 18 mounted thereon, a stiffening rod 24 seated within the channel of upper stopper 18, and a nut 26 threaded onto threaded area 28 of stiffening rod 24 and snugged down against upper stopper 18.

Figure 5B:
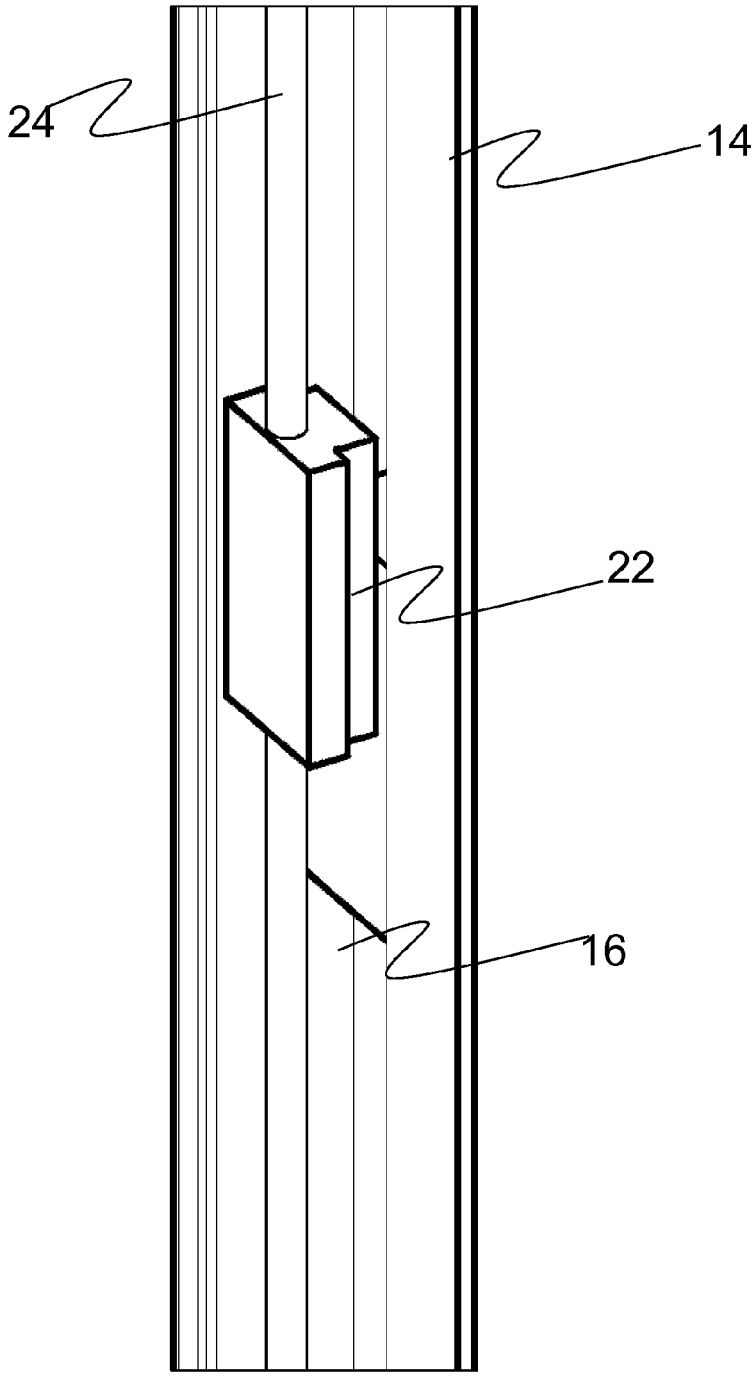

FIG. 5B shows a detail of a center region of a profile 14, wherein an optional center stopper 22 is mounted on track 16 therein and stiffening rod 24 is seated within the channel of center stopper 22.

Figure 5C:
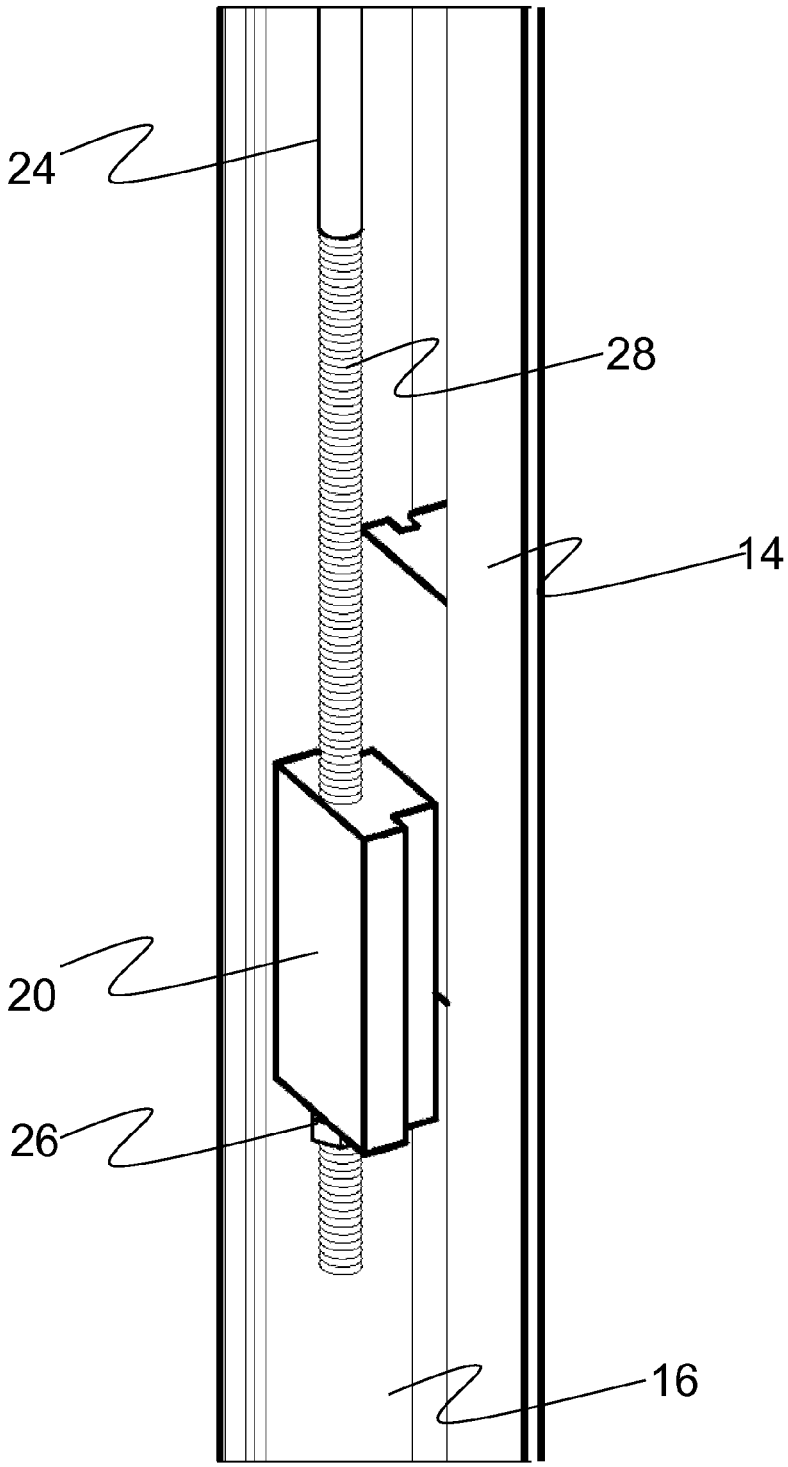

FIG. 5C shows a detail of the lower area of a profile 14, with a lower stopper 20 mounted thereon, a stiffening rod 24 seated within the channel of lower stopper 20, and a nut 26 threaded onto threaded area 28 of stiffening rod 24 and snugged up against lower stopper 20.

In order to more fully describe the present invention, the following describes a mode of use.

Profile 14 may be secured to the lateral edges of a sliding door 12 according to known in the art methods. Upper stopper 18, lower stopper 20, and, optionally, center stoppers 22 may then be affixed within track 16 of profile 14. Upper stopper 18 may be rigidly affixed below any hanging hardware that may be located in the upper region of sliding door 12; and lower stopper 20 may be rigidly affixed above any hanging hardware that may be located in the lower region of sliding door 12. One or more center stoppers 22 may also be rigidly attached to track 16, as needed to support stiffening rod 24. Upper stopper 18, lower stopper 20, and, optionally, center stoppers 22 may be attached by means of screws, nails, or any other appropriate attachment method.

Once upper stopper 18, lower stopper 20, and, optionally, center stoppers 22 are in place, a stiffening rod 24 may be inserted through the channels on each stopper 18, 20, and 22. According to some embodiments, a nut 26 may then be threaded onto threaded areas 28 located at each end of stiffening rod 24 and tightened down. In cases where the present invention has been attached to a new, straight sliding door 12, stiffening rod 24 helps sliding door 12 to maintain its unwrapped condition. In cases where the present invention is applied to a warped sliding door 12, as represented in FIG. 1, stiffening rod 24 helps straighten sliding door 12. This straightening is achieved by tightening nuts 26. As nuts 26 are tightened, the area of stiffening rod 24 between upper stopper 18 and lower stopper 20 is shortened, forcing sliding door 12 to straighten.

In some embodiments of the present invention, upper stoppers 18, lower stoppers 20, and optionally, center stoppers 22 may be affixed directly to a solid wooden sliding door 12, or any other type of panel door.

While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A system for reinforcing a door, said system comprising:

a. at least one metal profile removably applied to a lateral edge of said door, said metal profile comprises a track;

b. a plurality of stoppers each having a channel, wherein said stoppers are located in the track of said metal profile;

c. at least one stiffening rod having threaded areas, wherein said stiffening rod is seated within the channels of said stoppers in a manner that allows at least two of the stoppers to move along a respective said threaded area of said stiffening rod, said configuration allows preventing said stiffening rod from being bowed; and d. a plurality of nuts which are threaded onto said threaded areas of said stiffening rod for securing said stoppers to said stiffening rod at a desired location along said threaded area thereof, wherein said plurality of stoppers comprising at least three stoppers: an upper stopper, a lower stopper and a central stopper, said central stopper enables holding a middle section of said stiffening rod enabling thereby to divide said stiffening rod into at least two parts, and wherein said stiffening rod and said stoppers are all located inside the track of said metal profile, and wherein said stoppers and stiffening rod facilitate in preventing the door from being distorted or in correcting distortions already occurring in said door by enabling changing the location of the stoppers in relation to one another along said stiffening rod for shortening a bowing span of each part of said stiffening rod inside said metal profile, wherein each of said upper, lower and center stopper can be removably affixed at different locations to said profile track for allowing positioning of said stiffening rod at various locations in said profile track by adjusting the location of each respective said stopper in said track.

2. The system according to claim 1, wherein each said stopper is made of a sturdy material.

3. The system according to claim 1, wherein said metal profile track in which said stiffening rod is placed is open for allowing a user to access said stiffening rod, stoppers and nuts for changing said bowing span of said stiffening rod.

* * * * *